United States Patent [19]

Gavelin

[11] Patent Number: 4,889,594

[45] Date of Patent: Dec. 26, 1989

[54] METHOD FOR MANUFACTURING FILLER-CONTAINING PAPER

[75] Inventor: Gunnar Gavelin, Taby, Sweden

[73] Assignee: Mo och Domsjo Aktiebolag, Ornskoldsvik, Sweden

[21] Appl. No.: 128,653

[22] Filed: Dec. 3, 1987

[30] Foreign Application Priority Data

Dec. 3, 1986 [SE] Sweden ..... 8605182

[51] Int. Cl.[4] ..... D21F 11/00

[52] U.S. Cl. ..... 162/130; 162/149; 162/162; 162/181.1; 162/183; 162/189; 162/190

[58] Field of Search ..... 162/183, 216, 123, 129, 162/149, 190, 189, 158, 130, 162, 181.1

[56] References Cited

U.S. PATENT DOCUMENTS

| | | | |
|---|---|---|---|
| 1,880,045 | 9/1932 | Richter | 162/149 |
| 3,873,418 | 3/1975 | Brax | 162/190 |
| 3,884,755 | 5/1975 | Frost | 162/190 |

FOREIGN PATENT DOCUMENTS

86/04370 7/1986 PCT Int'l Appl. .

OTHER PUBLICATIONS

Britt, "Retention of Additives During Sheet Formation", *Tappi,* 56(3), Mar. 1973, pp. 83–86.

Arvela et al., "Effect of Polyelectrolyte Molecular Weight and Stock Agitation of Filler Retention", *Tappi,* 58(11), Nov. 1975, pp. 86–89.

Unbehend, "Mechanisms of Soft and Hard Floc Formation in Dynamic Retention Measurement", *Tappi,* 59(10), Oct. 1976, pp. 74–77.

"Coflocculation of Fines and Filler Particles," Gavelin, Gunnar, *Paperi ja Puu—Papper och Tra,* No. 11, Sweden, 1985, pp. 649–653.

*Primary Examiner*—Peter Chin

*Attorney, Agent, or Firm*—Sughrue, Mion, Zinn, Macpeak & Seas

[57] ABSTRACT

The invention relates to a method and apparatus for manufacturing paper or like products which contains retention agent and inorganic filler. The retention and technical properties of the paper are enhanced by co-flocculating the filler with a cellulosic material having a large specific surface area (fine pulp) prior to introducing floc suspension into the stock, and by subjecting the flocs to a floc size-controlling shearing process in a particular reaction vessel to produce flocs that have a mean particle size within the range of 2–4 mm. The particular reaction vessel used herefor incorporates a mixing zone, a flocculation zone, separator means located between the mixing zone and flocculation zone, a shearing zone and a sedimentation zone.

19 Claims, 2 Drawing Sheets

METHOD FOR MANUFACTURING FILLER-CONTAINING PAPER

TECHNICAL FIELD

The present invention relates to a method for manufacturing an improved filler-containing paper and an apparatus for carrying out the method. More particularly, although not exclusively, the invention relates to methods of paper manufacture in which the fibre suspension fed to the paper making machine has added thereto a filler, fine pulp and anionic, cationic and/or nonionic retention agents for improving retention of the filler on the wire, formation of the paper, strength properties, etc. The apparatus used for carrying out the method is of a kind which is particularly intended for coflocculating filler and fine pulp. By fine pulp is meant here and in the following pulps which have a large specific surface area, i.e. 5–10 $m^2/g$, such as groundwood pulp having a freeness value according to CSF (Canadian Standard Freeness) of 40–100 ml, a chemical or chemimechanical pulp ground to a freeness value according to CSF of 40–100 ml, or different fine fractions obtained when fractionating chemical, mechanical or chemimechanical pulps or with fibre recovery processes in connection with such pulps.

BACKGROUND PRIOR ART

The European Patent Specification publication number 0 041 056 teaches a method of paper manufacture in which inorganic filler, colloidal silica and cationic starch are added to an aqueous suspension of cellulose fibres upstream of the inlet to the paper making machine, inter alia for the purpose of enhancing paper strength and improving filler retention on the wire. Swedish Patent Application 8500162-6 teaches a method of paper manufacture in which an aqueous suspension of an inorganic filler is first mixed with fine pulp, whereafter a retention agent is added (coflocculation) and the flocs thus formed are introduced into the pulp suspension at a location upstream of the paper machine, thereby improving filler retention and enhancing paper properties.

SUMMARY OF THE INVENTION

Technical Problems

Although the method taught by EP 0 041 056 provides a very good result, it has the drawback of requiring the use of large quantities of expensive starch and is very difficult to apply in practice, due to the complexity of the added ingredients and their reactions with locally occurring substances, thus, the results may vary from plant to plant. The method according to the Swedish Patent Application 8500162-6, although presenting a simpler solution still causes problems in achieving a result which can be reproduced in practice. It has been found that the resultant flocs or filler and fine pulp are broken down to some extent prior to being charged to the pulp suspension, resulting in impaired retention and necessitating careful control of flocculation and degradation in a particular manner and with the aid of special apparatus, in order to achieve the result desired.

Solution

The present invention provides a solution to these problems. Accordingly, the invention relates to a method for manufacturing paper which contains inorganic filler, fine pulp and retention agents, which filler is thoroughly mixed with fine pulp in a reaction vessel and the resultant mixture is admixed with retention agent to form flocs which contain filler and fine pulp (coflocculation) and which are then fed to the stock upstream of the paper machine. The method is characterized in that the flocs formed are subjected to a size-controlling shearing process in the reaction vessel, such that large flocs are broken down and smaller flocs are agglomerated to form flocs having a mean particle size of from 2 to 4 mm.

The invention also relates to apparatus for carrying out the method of producing flocs of inorganic filler and fibre material with the aid of a retention agent when manufacturing paper and like products. The apparatus includes a reaction vessel (1) having located at the top thereof a mixing zone (2) which is provided with at least one inlet (3) for the supply of filler and/or fine pulp; a flocculating zone (4) which is located beneath the mixing zone and which is provided with one or more supply means (5, 6) for supplying retention agent to the flocculating zone; and an outlet (7) arranged in the bottom of the reaction vessel. The apparatus is characterized in that: between the mixing zone and the flocculating zone there is a liquid-permeable separator means (8) for mutually separating the material flows in the mixing and flocculating zones; a shearing zone (9) for controlling the size of the flocs formed is arranged in the close proximity of the flocculating zone; and arranged beneath the shearing zone (9) is a sedimentation zone (10) in which the floc supension is thickened and caused to settle.

Advantages

The method according to the invention affords a number of advantages. One of the most important of these advantages is that the invention enables flocculation to be effected more efficiently than was previously possible. Furthermore, when practising the invention, it is possible to obtain homogenous flocs of filler and fine pulp of a given mean particle diameter, which can also be adapted to the different requirements of each particular case. Furthermore, the flocs produced in accordance with the invention have surprisingly been found to be extremely strong and durable, so as not to disintegrate at the high pressures and the heavy shear forces that prevail in the headbox of the paper machine. Disintegration of the flocs results in impaired retention of fibres and filler and lowers the strength of the paper. Because of the homogenity of the floc suspension prepared in accordance with the invention and the durability of the resultant flocs, the paper produced is very strong, since the bonds between the fibres in the paper are not impaired by the filler to the same extent as in earlier methods. Furthermore, formation of the paper is enhanced as a result of a smaller proportion of unreacted retention agent in the stock.

The apparatus intended for carrying out the method is a simple, inexpensive and reliable construction for achieving the particular flow and flocculating conditions necessary for effectively coflocculating filler and fine pulp in accordance with the inventive method.

A further advantage afforded by the invention is that the consumption of retention agent can be greatly reduced in relation to known processes.

BEST EMBODIMENT

Figure 1:
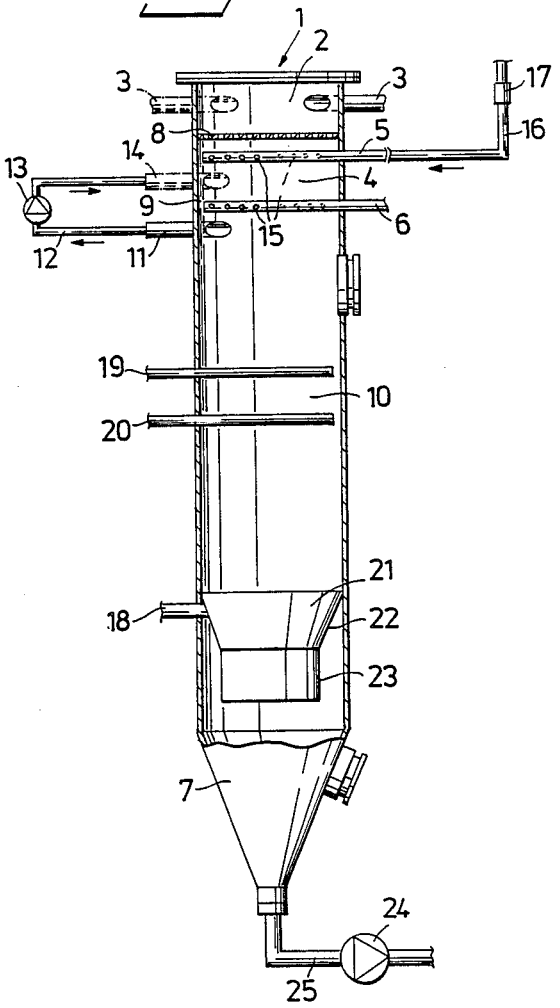
FIG. 1 is a section view through the centre of an apparatus suitable for carrying out the method according to the invention.

When carrying out the process of the invention, inorganic filler is coflocculated with fine pulp with the aid of one or more retention agents, prior to the filler being introduced into the stock fed to the paper machine. This results in larger and stiffer flocs than when the retention agent is added to the filler or the stock each per se. This is thought to be due to a binding between filler and fine pulp which results in strong and voluminous aggregates, although the nature of the bond is not truly understood. This in turn results in a larger and more uniform pore volume, a smoother surface and enhanced transverse distribution (Z-axis) of the filler in the resultant paper, when the floc suspension is mixed with the stock and formed on the wire. This results in a stronger paper and also increases the light-scattering coefficient thereof.

In accordance with the invention, the fine pulp used may be a pulp which contains a high proportion of fine-fraction, by which is meant here and in the following fibres which pass through a screen according to Bauer McNett having 59 openings/cm (150 Mesh) and a large specific surface area, i.e. 5–10 $m^2/g$. Suitable pulps in this regard are, e.g., groundwood pulp having a freeness of 40–100 ml CSF (Canadian Standard Freeness) and chemical or chemimechanical pulp ground to a freeness of 40–100 ml CSF, or various other fine fractions obtained when fractionating or recovering fibres from chemical, mechanical or chemimechanical pulps which have a high percentage of small particles and a large specific surface area, and also mixtures of said materials.

From a forming and retention aspect, however, the best results are not obtained by solely coflocculating the filler and fine fraction. It is important that in addition hereto the flocs generated are subjected to a size-controlling shearing process in which large flocs, i.e. flocs having a mean particle diameter above ca 4 mm, e.g. 4–7 mm, are broken down into smaller sizes, and that small flocs, i.e. flocs with a mean particle diameter beneath ca. 2 mm, e.g., 0.5–1 mm, are agglomerated to form flocs of larger size. It has been found that suitable mean particle diameters for the coflocculated particles to be fed to the stock system of the paper machine are 2.0–4.0 mm. Particularly suitable sizes in this regard are within the range of 2.5–3.5 mm. The suspension of coflocculated particles is thickened in the reaction vessel, suitably through gravitational forces (sedimentation) prior to being charged to the stock, since the forces which hold the particles together are so small that the particles are liable to be broken down if some other form of separation is applied. This sedimentation enables floc-free suspension liquid to be withdrawn from the lower part of the reaction vessel and recycled to an earlier step in the process, e.g. it can be added to the fine pulp suspension.

A size-controlling shearing process according to the invention can be effected by imparting helical or vortex rotational motion to the floc suspension in a separate shear zone in the reaction vessel and in the direction of transportation in a manner such as to generate a controllable shearing effect between mutually adjacent layers at mutually different distances from the centre of rotation. The velocity gradient radially in the vessel causes all flocs to be subjected to shearing forces which increase with the size of the floc and which are contingent on the distance to the centre of rotation and on the friction between flocs and flowing liquid. This shearing process results in all particles which are not well anchored in the flocs being released therefrom and forming new flocs.

The velocity gradient in the flow is also responsible for the collision of small particles with other small particles, so that new flocs form and grow until these new flocs also reach the maximum size which corresponds to the strength of the flocs and the magnitude of the radial velocity gradient. This latter occurrence explains why, when coflocculating in accordance with the invention, both fine filler particles and small fibre fragments, which normally render a fibre/filler suspension opaque, disappear from the liquid phase and become embodied in the flocs. Flocculation in accordance with the invention in a stable and precise shear field results in physical and chemical co-action between fibre fragments, filler and chemicals to an extent which cannot be achieved by mixing these ingredients directly into the stock.

This shearing process can be effected, for example, with the aid of a stirrer or agitator arranged concentrically or preferably eccentrically in the reaction vessel, and by regulating the shearing effect obtained by varying the speed at which the stirrer is driven. A preferred method of effecting a suitable size-controlling shearing process in accordance with the invention, however, comprises the steps of withdrawing all or part of the coflocculated suspension from the flocculation zone of the reaction vessel, circulating the withdrawn suspension in a branch or loop conduit connected in parallel with the vessel, and injecting the recycled suspension tangentially into the shearing zone in said vessel. This will impart a particularly suitable form of spiral or helical rotational movement to the floc suspension, with which the shearing effect and therewith the mean particle size can be controlled or regulated by varying the rate of flow in the loop or branch conduit, e.g. by using a variable speed screw pulp. The pump speed can be adjusted in correspondence with the formation of the paper produced, it being observed that low pump speeds may result in excessively large flocs, which results in a grainy paper, whereas excessively high pump speeds result in flocs of such small size as to impair retention. A suitable residence or stay time in the coflocculating zone is from 10 seconds to 10 minutes, and is preferably from 30 seconds to 3 minutes.

Mixing of fine pulp and filler can be effected by introducing separate flows thereof into a mixing zone in the reaction vessel. A particularly suitable procedure in this regard is to combine the suspensions of fine pulp and filler prior to their introduction into the mixing zone, e.g. by supplying the filler suspension to the suction side of the pump used to supply the fine pulp. A flow rate of 0.5–5 m/sec and a concentration of 10 g/l in the case of fine pulp and ca. 75 g/l in the case of filler have been found particularly suitable in this regard.

In accordance with the invention, retention agent is charged to a separate flocculation zone in the reaction vessel, wherewith flocs of fine pulp and filler are formed. The retention agent shall be introduced into said zone in a manner such that the retention agent is dispersed rapidly throughout the whole of the fine-pulp and filler flow without coming into contact with the pulp and filler during their mixing stage. The supply of retention agent can be effected through the medium of a perforated pipe arranged concentrically and vertically in the vessel, so as to spread the retention agent radially, or through the medium of a peripherally arranged injection ramp. It is preferred, however, to inject the retention agent through a perforated pipe arranged horizontally in the reaction vessel, with the perforations preferably being located on the downstream side.

Preferably, separate zones are arranged in the reaction vessel for mixing and flocculation purposes respectively. The mean particle size of the resultant flocs is controlled or adjusted in the aforesaid manner in a shearing zone in the vessel, wherewith the flocculation zone and the shearing zone may partly overlap one another in the vessel. A delimiting means, e.g. a perforated plate, is preferably arranged between the mixing zone and the flocculation zone.

Suitable retention agents for use in accordance with the present invention are high molecular weight polymers which provide an irreversible bridge formation between anionic particles. Anionic, cationic and non-ionic polymers can be used herefor. In order to utilize the polymer charged to the system effectively and to obtain effective flocculation, it is necessary for each polymer molecule to come into contact with the largest number of particles possible. Bonds between polymer chains should be avoided and consequently the retention agent should be introduced while thoroughly, but gently, mixing filler and fine pulp at the same time. When introducing a retention agent directly to the stock in a paper machine, a large proportion of cationic retention agent is consumed by reaction with anionic solubilized substances in the white water. When coflocculating in accordance with the invention, on the other hand, flocculation is effected in the presence of solely a small proportion of these substances (5%) and when the flocs come into contact with the white water at a later stage, the retention agent has already reacted and is, to the greater part, bound to active groups on the fine pulp and filler. Consequently, the dissolved substance has a less deleterious effect and the consumption of retention agent is reduced.

The fibre concentration in the flocculation zone of the reaction vessel should be maintained within the range of 0.5–3.0% by weight, preferably 1.0–2.0% by weight.

The use of a cationic retention agent according to the invention has two functions; to enable flocculation by lowering the Z-potential of the suspended particles and to form polymer bridges or links between the particles. This latter reaction requires firstly good contact possibilities between the particles, which is favoured by the high concentrations, and secondly polymer molecules which, due to repulsion between charged groups on the molecular chains, are held extended so as to be able to bridge the spaces between the particles. It is known that a high ion content in the water neutralizes this repulsion by shielding the surface charge, and allows the molecules to generate randomly formed spheres or nodules which impairs their ability to form bridges. However, since the coflocculation process according to the invention takes place at an ion concentration which is considerably lower than that in the headbox, the bridge forming process will also be more effective than with the conventional use of retention agents.

When retention agent is used in accordance with conventional processes, there is often observed an impairment in paper formation—flocculation in the paper—which is due to the fact that the retention agent has not reacted solely with fibres and filler in the stock, but has also neutralized the electric charge in the headbox stock, resulting in the flocculation of fibres—a process which is naturally undesirable. When coflocculating in accordance with the invention, neutralization of the charges takes place in the coflocculating vessel, but the process can be controlled so that the Z-potential is still sufficiently negative in the headbox to prevent fibre flocculation from taking place. This explains the marked improvement observed in the paper formation. Retention of the flocs in the paper is caused by two mutually contributory reaction processes. According to the first of these processes, the flocs are filtered out and fasten in the meshes of the fibre network on those sites at which they are located when the fibre network is consolidated during the process of dewatering the stock on the wire of the paper machine. According to the second of these processes, which applies when using a cationic retention agent, the cationic flocs are attracted to anionic fibre surfaces in the fibre network, which amplifies the filtering process and contributes towards uniform distribution of the flocs in the direction of the Z-axis of the paper.

Retention is improved with the size and strength of the flocs, but if the size and strength of the flocs are taken too far, the paper will obtain a grainy or gritty appearance. The desired floc size is determined by the strength of the shear fields through which the flocs must pass in pump and headbox in the paper machine.

The method according to the invention is not dependent on any particular kind of retention agent. The choice of retention agent depends on those demands placed on the process and on paper quality. A few retention agents which can be used in accordance with the invention are given below:

Polyacryl amide, retailed by Allied Colloids Ltd. under trademark PERCOL®, which can be obtained at various molecular weights and degrees of substitution and in cationic, anionic or non-ionic form.

Polyethylene imine, retailed by BASF under the trademark POLYMIN®, normally cationic and with a molecular weight of 50.000. This compound imparts particularly good dewatering ability to the stock.

Polyethylene oxide (non-ionic) retailed by Union Carbide under the trademark POLYOX® and by Berol Scandinavia AB under the trademark BEROCELL®439. This compound is suitable for stock systems containing a high proportion of colloidal and dissolved anionic material which consumes cationic retention agents.

Cationic starch can be added to the stock in order to increase the dry strength of the paper or to reduce the Z-potential of the system and cause coagulation of fine fraction and filler.

Other polymers of the type polyamide, polyamide-amine condensate, cationic polystyrene latex, and inorganic compounds of the type sodium aluminate can also be used as retention agents in accordance with the present invention.

It is also possible when practising the invention to use combinations of different retention agents, e.g. two-component systems or three-component systems. For example, a cationic retention agent can be combined with an anionic agent, in which case the cationic agent is preferably introduced into the flocculation zone of the reaction vessel and the anionic agent introduced at a location somewhat further down in the vessel. It may be advantageous at times to add one of the retention agents, either totally or in part, to the stock passing to the paper machine, and the other retention agent to the coflocculation vessel. This is convenient when wishing to combine good dry strength, obtained by adding starch to the stock, with high filler retention, which is achieved when introducing a retention agent into the reaction vessel. This can also apply when wishing to further enhance dewatering of the stock. In this latter case, however, the amount in which retention agent is metered to the stock must be minimized so as to obtain the least possible reduction of the formation.

A two-component system which can be used very effectively when practising the invention consists of cationic starch in combination with anionic colloidal silica retailed by EKA NOBEL AB under the trademark COMPOZIL ®. In this case, however, part of the starch should be introduced into the stock.

Another suitable two-component system is a cationized bentonite in combination with an anionic polyacryl amide, which is retailed by Allied Colloids Ltd. under the trademarks ORGANOPOL ® and ORGANOSORB ® respectively. When this system is used a large part of the bentonite should be added to the stock in order to adsorb interference substances without disturbing paper formation. Bentonite and polyacrylamide are metered to the coflocculation vessel in quantities sufficient to obtain good retention of the filler.

A further suitable two-component system comprises a cationic polyacryl amide in combination with anionic bentonite, which is retailed by Allied Colloids under the trademark HYDROCOL ®. In this case it is preferable to break up the large flocs obtained with a large dosage of polyacryl amide and then agglomerate the floc fragments with bentonite. The polyacryl amide is therefore introduced to the coflocculation zone whereas the bentonite is added to the stock upstream of the headbox, which reduces the polymer consumption, since solely filler and fine pulp need be flocculated.

A further two-component system which can be used according to the invention is bentonite in combination with polyethylene oxide which is particularly suitable in stock systems of high anionicity.

Cationic starch can be used in combination with anionic polyacryl amide as an inexpensive alternative to using COMPOZIL ®.

With stock systems of low lignin content it is suitable to "charge" the fibres with phenol groups so as to bind the polymer to the surfaces of the fibres and produce stronger flocs. In cases such as these there can be used a two-component system that contains phenol formaldehyde resin in combination with polyethylene oxide.

Should the polyethylene imine not give a sufficiently good result, it can be combined with anionic polyacryl amide. If the polyethylene imine does not flocculate colloidal material, it can be combined with ca 10% cationic polyacryl amide.

Suitable three-component systems for use in accordance with the invention are the combination cationic starch/-anionic polyacryl amide/cationic polyacryl amide and the combination bentonite or colloidal silica-/anionic polymer/cationic polymer.

Strictly speaking the fine pulp in the coflocculation process can be considered to constitute a retention chemical having high anionicity, high specific surface area and very good bridge forming abilities, and consequently the fine pulp and the retention agent can be said to form a two-component system which can be upgraded to a three-component system by adding a further chemical thereto, e.g. a cationic starch.

According to one particularly suitable embodiment of the invention, non-consumed retention agent is recycled to the process, for example by firstly returning the floc suspension to the flocculation zone in the reaction vessel during the controlled shearing process, and secondly by taking from the sedimentation zone at the bottom of the reaction zone suspension liquid having a low residual content of retention agent and recycling this liquid to the flocculation zone. This will result in a higher concentration of retention agent in the reaction vessel, therewith making flocculation more effective and reducing the consumption of retention agent. Furthermore, when practising this embodiment, less residual retention agent will accompany the flocs to the paper machine, where as a result of its floccculating effect the retention agent is liable to have a disturbing influence on paper formation.

The concentration of retention agent in relation to the concentration of fibres at the time of flocculation is approx. 15 times greater when carrying out the method according to the invention than with earlier known methods.

According to one particularly suitable embodiment of the invention, size is added to the floc suspension in the sedimentation zone of the reaction vessel immediately after the coflocculation process, in order to render the flocs hydrophobic and therewith impart size stability to the paper. It has been found that good stock sizing can be achieved by precipitating size particles on a minor part, e.g. 10%, of the stock flow, particularly when this part has a large specific surface area. Fillers have a specific surface area which is about nine times greater than the surface area of the whole fibres contained in a stock and the fine pulp as defined here in accordance with the invention has a specific surface area which is five times as great, and both absorb from 16 to 20 times as much size per unit of weight as the normal stock, because the size precipitates in a multiple of molecular layers thereon but in monomolecular layers on whole fibres.

Consequently, the supply of fine pulp and filler normally has a very unfavourable effect on sizing processes carried out on filled paper. However, when the fine pulp and filler are first coflocculated into large flocs in accordance with the invention and a sizing agent is then added, the particles of sizing agent will not penetrate into the flocs, but lie on the surface thereof and therewith render the sizing process much more effective. Any non-precipitated size will be transported together with the flocs into the stock, where the sizing process is terminated. The strong, size-coated flocs of fine pulp-/filler will fasten in the fibre network of the paper during the dewatering process and be distributed in the direction of the Z-axis, therewith improving the size stability of the paper and further improving retention of the filler. The addition of size in accordance with the invention affords particular advantage when manufacturing magazine paper for offset printing purposes.

The size may be added in one or more stages. For example, a size solution may first be added to the coflocculated particles at the beginning of the sedimentation zone of the reaction vessel, and then followed by a size fixating agent which is supplied later in the sedimentation zone.

A particular advantage is afforded when a cationic size is added.

It is also possible when practising the method according to the invention to introduce a dye solution into the reaction vessel in conjunction with the coflocculation process, preferably into the sedimentation zone, and also a dye fixating agent although at a somewhat later level in the flow direction. Due to the fact that during coflocculation the dye solution is added to a smaller flow of filler than with conventional charging processes and is mixed more efficiently, the dye is absorbed by the solid substances to a greater extent. It is also possible in accordance with the invention to pass one or more coflocculated flows of filler and fine pulp to one or more headboxes of a paper machine having a multiple of headboxes in order to provide a paper of particular structure.

The apparatus for carrying out the method according to the invention must be constructed in a particular manner in order to ensure that the effect provided by the method can be achieved. The input components, i.e. inorganic filler, fine pulp, retention agent and, when used, size and size fixer, are introduced into a particular reaction vessel which is preferably of cylindrical shape and constructed so that the filler and fine pulp charged thereto can be mixed and homogenized effectively. Retention agent shall then be added in a manner which will ensure that it disperses rapidly throughout the suspension, although without coming into contact with the suspension during the stage of mixing the filler and fine pulp together. The reaction vessel must therefore incorporate separate mixing and flocculating zones which are shielded from one another to the greatest extent possible, and it shall also be ensured that any turbulence occurring in the flocculation zone is so low as not to prevent flocs from being formed. Preferably, the flocculated particles are thickened by sedimentation in the reaction vessel. The vessel shall also include a controllable shearing zone in which the coflocculated particles are subjected to a size-controlling shearing process upstream of the outlet from the vessel. The vessel will also have at its lowest point an outlet for the coflocculated suspension, this outlet being dimensioned for a rate of flow of about 0.5–5 m/sec. The vessel must also be dimensioned to withstand the high pressure in the headbox of the paper machine (2–8 bars).

An apparatus suitable for carrying out the invention is illustrated in FIG. 1.

Figure 1A:
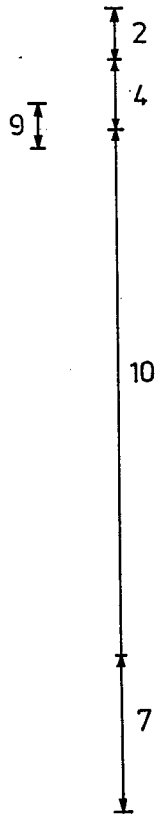
FIG. 1A illustrates various zones in the apparatus.
Figure 1B:
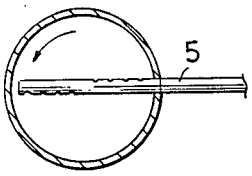
FIG. 1B is a cross-sectional view of the apparatus from above.

The reaction vessel 1 is preferably cylindrical and is dimensioned so that the residence time of the flocs formed is sufficiently long to form and consolidate the flocs. A cross-sectional area which affords a vertical flow rate of 50–200 mm/sec is a suitable dimension in this regard. The uppermost part of the vessel constitutes a mixing zone 2 and has arranged therein to this end one or more inlets 3 for the supply of filler and fine pulp to the vessel. In the embodiment illustrated in FIG. 1 it is assumed that filler is introduced through the right inlet and fine pulp through the left, although it is also possible to mix filler and fine pulp in a pump upstream of the reaction vessel and to use solely one inlet to the mixing zone. The inlets are preferably tangential to the zone. Located beneath the mixing zone 2 is a flocculation zone 4, into which one or more retention agents are introduced with the aid of supply means 5, 6. A separator 8 is placed between the mixing zone and the flocculation zone in order to separate the flows in the two zones one from the other, although without appreciably hindering the throughflow of material in the flow direction. The separator 8 may suitably comprise a perforated plate which has a 40–60% open area and which delimits the mixing zone and prevents eddy currents or vortex flows containing retention agent from passing from the flocculation zone to the mixing zone. The supply means 5, 6 may also be constructed to introduce retention agent from peripheral locations on the reaction vessel and then suitably in a direction transverse to the flow of material. This can be effected with the aid of a so-called injection ramp, i.e. a pressurized container which is mounted around the circumference of the vessel, and which incorporates a multiple of jets or orifices through which retention agent can be injected or sprayed into the vessel. It is preferred, however, to supply the retention agent in fine jets within the actual vessel itself, which can be effected with the aid of perforated pipes extending into the vessel. These pipes may either be arranged parallel with the direction of flow (vertically) or transversely to said direction (horizontally), this latter variant being the one illustrated in FIG. 1. The illustrated variant is preferred, and a particular advantage is afforded when the perforations 15 are located horizontally on the sides of the pipes and on the "leeward" side of the horizontal vortex in the flocculation zone, as illustrated in FIG. 1B. Although the retention agent may by supplied continuously in a uniform flow, it is particularly suitable from the aspect of flocculation to supply the retention agent in a pulsatile flow. This can be achieved by connecting the supply means 5, 6 to a piston pump 17 through a conduit 16. Located in the proximity of the flocculation zone is a shearing zone 9 for controlling or regulating the size of the flocculated particles, although without appreciably influencing the flow of material through the vessel and sedimentation of the particles. This shearing process can be effected with the aid of a stirrer or agitator whose speed can be controlled and which is arranged in the shearing zone. A particularly suitable variant in this regard, however, is the variant illustrated in FIG. 1, which comprises an outlet 11 provided at the lower part of the shearing zone and connected to an inlet 14 provided at the upper part of said zone, by means of a branch or loop pipe 12 and a pump 13. The inlet and outlet are preferably tangential. This arrangement affords perfect control of the floc sizes for each desired purpose, e.g. different paper qualities, layer properties, types of retention agent, etc., so as to achieve the improvements intended with regard to retention, paper quality, and formation. The shearing zone 9 is preferably arranged to overlap the flocculation zone 4 in order to effect a given circulation of liquid in said zone. By withdrawing a given quantity of liquid from the flocculation zone through the outlet 11 and returning this liquid through the tangential inlet 14, the whole volume of liquid in the flocculation zone is caused to rotate so as to obtain a stable and precisely controlled shear field, which field is impossible to reproduce by any other mixing procedure in which fibres, filler and chemicals are mixed directly in the stock. Arranged in the reaction vessel beneath the shearing zone 9 is a sedimentation zone 10, in which the resultant floc suspenson is thickened and caused to settle, upstream of the vessel discharge outlet 7. The vertical extension of the respective zones in the reaction vessel is shown more clearly in FIG. 1A. The sedimentation zone may have arranged therein means for supplying a sizing agent and a size fixation agent to the zone, as illustrated at 19 and 20 respectively. According to one particularly suitable variant of the invention, the sedimentation zone has arranged in its bottom region, in the vicinity of the outlet, means 18 for taking out clear suspension liquid and for recycling this suspension to the flocculation and/or the mixing zone, this procedure affording several advantages, among which are included improved utilization of fibres and chemicals. A particular advantage is afforded when there is provided in the lower region of the sedimentation vessel a substantially funnel-shaped separator means 21 which is firmly connected to the inner wall of the reaction vessel and which forms an annular upwardly closed space whose upper part is connected with the means 18. This facilitates withdrawal of substantially floc-free suspension liquid from the sedimentation zone. It is particularly suitable in this regard to provide the funnel-shaped separator 21 with an upper conical part 22 and a lower cylindrical part 23.

Figure 2:
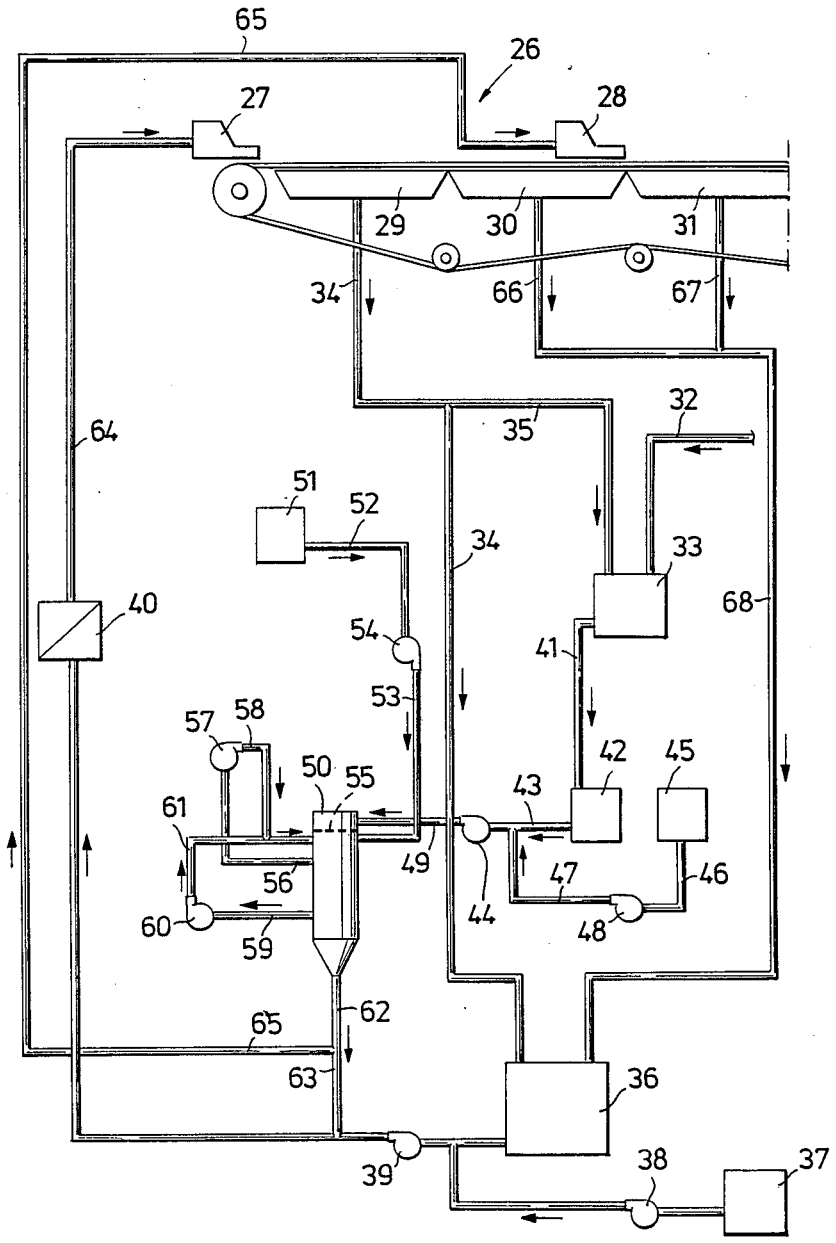
FIG. 2 is a view which shows the invention apparatus connected to the stock and white water system of a paper machine.

The outlet part 7, which is preferably conical, has connected thereto a conduit 25 through which coflocculated fine pulp and filler is conducted to the paper machine via a valve 24, for mixing with the stock. FIG. 2 illustrates various methods of mixing in the coflocculated pulp and filler, together with different circulation flows to and from the coflocculation arrangement. In FIG. 2, reference numeral 26 designates a paper machine having two headboxes 27, 28 and suction boxes 29, 30 and 31. Fine pulp is passed through a pipe 32 to a mixing vessel (pulper) 33, into which part of the white water from the first suction box 29 is also introduced, through pipes 34 and 35. The remainder of the white water is passed to the collecting vessel (the wire pit) 36, to which white water is also passed from the suction boxes 30 and 31 through respective pipes 66, 67 and 68 in a conventional manner. A 3%-stock is pumped from the machine tank 37 by the pump 38 to the suction side of the pump 39, to which white water from the wire pit 36 is also passed. The thus diluted or thinned stock is pumped through the pipe 64 and through the screen 40 to the headbox 27. The resultant fine pulp suspension is passed from the mixing vessel or pulper 33 to the fine pulp tank 42, via pipe 43, and is removed therefrom through the pipe 43 and passed to the suction side of the pump 44. Filler suspension is taken from the tank 45 and pumped by the pump 48 to the suction side of the pump 44, through the pipes 46 and 47. The mixture of fine pulp and filler is pumped through the pipe 49 to the mixing zone in the reaction vessel 50. Retention agent from the tank 51 is pumped by the pump 54 through the pipes 52 and 53 to the flocculation zone of the reaction vessel, the flocculation zone being separated from the mixing zone by the separator means 55. The floc suspension is removed from the shearing zone of the reaction vessel and passed through the pipe 56 to the flow control pump 57, which returns the floc suspension to the shearing zone, through the pipe 58. Clear filtrate from the lower part of the sedimentation zone of the reaction vessel is removed through the pipe 59 and pumped by the pump 60 back to the flocculation zone through the pipe 61. Floc suspension is taken through the pipe 62 from the bottom of the reaction vessel 50, in which a pressure considerably higher than the headbox pressure is maintained. Part of the flow in the pipe 62 is passed through the pipe 63 to the stock pipe 64, while a further part of said flow is passed through the pipe 65 to the headbox 28. Thus, white water taken from the first suction box and containing a relatively high proportion of fine fibres and filler is introduced into the coflocculation vessel, where it is incorporated in the flocs and utilized. By passing a part of the floc suspension from the coflocculation vessel to the second headbox 28, which box is located at a position in which sheet forming has already taken place (the wet line), there will be deposited on the upper surface of the finished sheet a well bonded filler, which is highly beneficial when the upper surface of the paper or paperboard under manufacture is required to have particularly good printability.

The following examples illustrate the method of application of the invention.

EXAMPLE 1

Tests which included coflocculation in accordance with the invention and in which coflocculation was omitted were run in a plant according to FIG. 2, but without utilizing the second headbox 28 and its associated supply pipe 65. The pumps 57 and 60 were shut down, so that there was no flow through the pipes 56 and 59. The stock flowing through the pipe 64 was a 1%-suspension of a pulp of which 60% comprised birch sulphate and 40% pine sulphate and which contained 0.7% rosin size calculated on the weight of the pulp. The pH of the stock had been adjusted to 4.5, with alum and alkali. In the case of the test carried out in accordance with the invention, a spruce groundwood pulp having a freeness of 70 ml (CSF) and a specific surface area of 4 $m^2/g$ was passed through pipe 32 to the mixing vessel 33, from where it was passed to the fine pulp tank 42, where the pulp consistency was 11 g/l. Fine pulp was taken out through the pipe 43, the rate of flow therein being 250 l/min. A filler consisting of kaolin at a concentration of 75 g/l was also delivered to the pipe 43, through the pipe 47, at a rate of 180 l/min. Thus a flow of filler/fine pulp was introduced tangentially into the mixing zone of the reaction vessel at a rate of 430 l/min and at a speed of 4 m/sec, whereby the total volume of liquid present was imparted a rotary motion with the same peripheral velocity. A retention agent containing cationic polyacryl amide was taken from the retention agent tank 51 and pumped through the pipe 53 into the flocculation zone of the reaction vessel. The concentration of retention agent in the pipe 53 was 1 g/l and the rate of flow 20 l/min, corresponding to an addition of 200 mg retention agent for each kilogram of finished paper. The means used to deliver the retention agent were of the kind illustrated in and hereinbefore described with reference to FIG. 1B. The various components in the flocculation zone had the following concentrations:

| | |
|---|---|
| Fine fibre | 6 g/l |
| Kaolin | 30 g/l; and |
| Retention agent | 0.04 g/l. |

The residence time in the reaction vessel from inlet to outlet was 45 seconds. The formed floc suspension had a mean particle size of 2.4 mm and was removed from the bottom of the reaction vessel and passed through the pipe 62 and into the pipe 64, for delivery to the headbox 27. A comparison test was run in which the same quantities of groundwood pulp and kaolin were charged to the machine tank 37 using conventional supply methods, whereas the retention agent was passed to the pipe 64 upstream of the screen 40, in an amount equal to that used in the former test. The paper produced in the tests was analyzed in respect of its paper technical properties. The results of these analyses are given below in Table 1.

| | Conventional Paper | Paper produced in accordance with the invention |
|---|---|---|
| Tensile energy absorption index | 26.4 | 37.2 |
| Tear index | 5.6 | 7.4 |
| Flexural strength | 64 | 86.6 |
| Brightness ISO % | 82 | 82 |
| Roughness ml/min (Bendtsen) | 335 | 380 |
| Air permeance ml/min | 780 | 500 |
| Scott Bond J/m$^2$ | 126 | 189 |
| Formation, (scale 0–100) | 17 (acceptable) | 42 (very good) |
| Retention filler % | 91.5 | 94.8 |

The results show that the method according to the invention is highly advantageous with regard to the properties of the paper produced and to its formation, while at the same time considerably improving retention of the filler.

EXAMPLE 2

Example 1 was repeated but with the difference that the pump 57 was started, so as to obtain through the pipes 56 and 58 of the FIG. 2 embodiment a flow of suspension liquid at 100–300 liters per minute. In the FIG. 1 illustration, this corresponds to the removal of liquid through the tangential outlet 11 in the shearing zone of the reaction vessel and the return of this flow to the flocculation zone through the tangential inlet 14. The speed of the variable speed pump 57 was set at a level which gave the best formation and retention results. An optimum was obtained with a flow of 175 liters per minute and a mean particle size of 3.1 mm, which gave a reading of 44 on the formation meter, i.e. slightly better than that obtained in Example 1. The lowest turbidity in the white water of the paper machine was also obtained at this level. The Example shows that the application of a shearing zone in accordance with the invention enables the quality of the paper to be readily optimized during manufacture and allows the process to be adapted continuously to prevailing conditions and also to possible changes in conditions.

EXAMPLE 3

Example 1 was repeated, but with the difference that the pump 60 was started, such as to obtain a flow of floc-free suspension through the pipes 59 and 61, the rate of this flow being 200 l/min. In the case of the FIG. 1 illustration, this corresponds to removing suspension liquid through the outlet 18 at the lower part of the sedimentation zone and delivering this removed liquid tangentially to the flocculation zone through the inlet 14. This resulted in an increase in the flow through the reaction vessel from 450 l/min to 650 l/min, while, at the same time, the fibre concentration in the flocculation zone fell from 6 g/l to 4 g/l and non-reacted retention agent was recovered, such that the amount of free retention agent in the outlet pipe 62 was reduced by 15%. The flocs had a mean particle size of 3.5 mm. Recycling of non-reacted retention agent lowered the requirement of retention agent by 15%, which enabled the supply of filler to be reduced quantitatively and the fine-pulp concentration in the supply pipe to be increased without raising the flow concentration in the reaction vessel.

EXAMPLE 4

Example 1 was repeated, but with the difference that a 2%-solution of phenol formaldehyde resin acidified to pH 6 was charged to the fine-pulp mixing tank 42 at a flow rate of 10 l/min, corresponding to 200 g/min, dry solids content. Thereby there was established an advantageous content of phenol groups in the fine pulp. A retention agent based on polyethylene oxide was delivered through the perforated pipe 5, the concentration being 1 g/l and the flow rate 20 l/min, which corresponds to an addition of 200 g for each tonne of paper. The resultant floc suspension had a mean particle size of 3.4 mm and the flocs were very strong. Retention was 96.3% which is a further improvement on the retention obtained in Example 1.

EXAMPLE 5

Example 1 was repeated, but with the difference that a 0.5%-solution of cationic starch was prepared and introduced into the stock in the machine tank 37, in an amount corresponding to 5 kg/tonne of finished paper. At the same time, starch solution was delivered to the flocculation zone through the perforated pipe 5 at a rate of 60 l/min, corresponding to 3 kg for each tonne of finished paper. The resultant floc suspension was stabilized, by supplying a suspension of colloidal silica having a concentration of 10 g/l through the perforated pipe 6, corresponding to an addition of 1 kg per tonne of finished paper. The dry strength of the paper obtained was greater than the dry strength of the paper obtained in Example 1.

EXAMPLE 6

Example 1 was repeated, but with the difference that alum was introduced to the stock present in the machine tank 37 in an amount corresponding to pH 6.3. A cationic size dispersion was introduced into the sedimentation zone of the reaction vessel through the pipe 19. The size concentration was 100 g/l and the rate of flow 5 l/min, corresponding to an addition of 5 kg for each tonne of finished paper. The paper produced had good size stability with a Cobb number of 40 g/m$^2$, despite the fact that no size was added to the stock in the machine tank.

EXAMPLE 7

Example 1 was repeated, but with the difference that half the flow of floc suspension from the reaction vessel was passed to the first headbox 27 on the paper machine, whereas the remaining half was passed to the second headbox 28 (cf FIG. 2), which was located on the wet-line of the wire, i.e. where the water mirror terminated and the dry solids content was about 4%. The floc suspension, which was very readily dewatered, was drawn rapidly into the paper web. Analysis of the paper produced showed that it had a higher ash content on its upper surface than on its wire side and that the surface bonding strength, according to Scott Bond had increased to 205 J/m$^2$, which indicated that the filler was well bonded in the paper, due to the embedment of the filler particles in the fine pulp particles. The achieved effect is particularly valuable when producing surface layers on paperboard and one-side coated paper.

I claim:

1. A method of manufacturing paper using a paper machine in which stock is fed to a headbox of said machine to form the paper, said method comprising the steps of:

introducing filler and pulp containing a high proportion of pulp fines into a reaction vessel;

mixing said filler with said pulp containing a high proportion of pulp fines in said reaction vessel to form a resultant mixture;

admixing the resultant mixture with retention agent in said reaction vessel to form flocs which contain the filler and said pulp containing a high proportion of pulp fines (coflocculation);

subjecting the flocs to a size-controlling shearing process in said reaction vessel for breaking down large flocs and agglomerating small flocs to form flocs having a mean particle size in a range of 2 to 4 mm; and feeding the flocs to the stock upstream of the headbox, wherein the size-controlling shearing process is effected in a shearing zone in the reaction vessel in which the floc suspension is imparted with a helical rotational motion in the flow direction thereby engendering a controllable shearing effect between adjacent layers at varying distances from the center of the rotation.

2. A method according to claim 1, wherein the mean particle size is caused to lie in the range of 2.5–3.5 mm.

3. A method according to claim 1, wherein prior to being charged to the stock the suspension of said flocs containing filler and fine pulp is thickened gravitationally, whereupon floc-free liquid is withdrawn from the lower part of the vessel and returned to the fine pulp.

4. A method according to claim 1, wherein the shearing effect is engendered with the aid of an eccentrically located stirrer means.

5. A method according to claim 1, wherein the size-controlling shearing effect is effected by withdrawing coflocculated suspension from a flocculation zone in the reaction vessel, circulating the coflocculated suspension through a branch pipe connected in parallel with the reaction vessel, and returning the coflocculated suspension to the shearing zone by injecting said suspension tangentially into said zone, and controlling the floc size of the particles by varying the rate of suspension flow in said branch pipe.

6. A method according to claim 1, wherein fine pulp and filler are mutually combined prior to being introduced into a mixing zone in the reaction vessel.

7. A method according to claim 1, wherein retention agent is introduced into the flocculation zone of the reaction vessel.

8. A method according to claim 1, wherein two or more mutually different retention agents are introduced into the flocculation zone.

9. A method according to claim 1, wherein non-reacted excess retention agent is recycled.

10. A method according to claim 5, wherein a fibre concentration in the flocculation zone of the reaction vessel is maintained within the range of 0.5–3.0% by weight.

11. A method according to claim 1, wherein size is added to the coflocculated particles of fine pulp (fraction) and filler in a sedimentation zone in the reaction vessel.

12. A method according to claim 11, wherein size solution is first added to the coflocculated particles in the sedimentation zone and then a size fixating agent is added thereto.

13. A method according to claim 1, wherein dye solution and dye fixating agent is added to the coflocculated particles of fine pulp (fraction) and filler in a sedimentation zone in the reaction vessel.

14. A method according to claim 1, wherein white water from the paper machine is introduced into the fine pulp prior to said coflocculation process.

15. A method according to claim 1, wherein at least one flow of coflocculated filler and fine pulp is delivered to at least one headbox in a paper machine provided with multiple headboxes.

16. A method according to claim 5, wherein a fiber concentration in the flocculation zone of the reaction vessel is maintained within a range of 1.0–3.0% by weight.

17. A method according to claim 14, wherein the white water is from a first section of the wire.

18. A method according to claim 1, wherein said pulp has a freeness in a range of 40 to 100 ml CSF (Canadian Standard Freeness).

19. A method according to claim 1, wherein said filler and pulp containing a high proportion of pulp fines are combined prior to introduction into said reaction vessel.

* * * * *